US005614121A

United States Patent [19]

Terao et al.

[11] Patent Number: 5,614,121

[45] Date of Patent: Mar. 25, 1997

[54] REFRACTORY BLOCK FOR CONTINUOUS CASTING

[75] Inventors: Masaru Terao; Noboru Tsukamoto, both of Okayama-ken; Yukinobu Kurashina, Iwaki; Kenji Yamamoto, Okayama-ken; Junichi Inoue; Hiroyasu Uiji, both of Bizen, all of Japan

[73] Assignee: Shinagawa Refractories Co., Ltd., Tokyo, Japan

[21] Appl. No.: 356,265

[22] PCT Filed: Mar. 22, 1993

[86] PCT No.: PCT/JP93/00332

§ 371 Date: Dec. 15, 1994

§ 102(e) Date: Dec. 15, 1994

[87] PCT Pub. No.: WO93/25333

PCT Pub. Date: Dec. 23, 1993

[30] Foreign Application Priority Data

Jun. 18, 1992 [JP] Japan ..... 4-041997 U
Jul. 7, 1992 [JP] Japan ..... 4-047365 U

[51] Int. Cl.[6] ..... B22D 11/10

[52] U.S. Cl. ..... 222/603; 222/600; 222/606

[58] Field of Search ..... 266/236, 44; 222/590, 222/591, 600, 603, 606, 607

[56] References Cited

U.S. PATENT DOCUMENTS 5,100,035 3/1992 Dunworth et al. ..... 222/603
5,198,126 3/1993 Lee ..... 222/606
5,335,833 8/1994 Rancoule ..... 222/600

FOREIGN PATENT DOCUMENTS 52-39533 3/1977 Japan .
59-180848 12/1984 Japan .
61-33745 2/1986 Japan .
61-126957 6/1986 Japan .
62-259663 11/1987 Japan .
2-220766 9/1990 Japan .
2-35405 9/1990 Japan .
4-182048 6/1992 Japan .
2179573 3/1987 United Kingdom ..... 222/603

*Primary Examiner*—Scott Kastler
*Attorney, Agent, or Firm*—Larson and Taylor

[57] ABSTRACT

A refractory block for continuous casting is disclosed comprising a unitary assembly including a plate brick having a top, bottom, sides and a passageway therethrough; a gas permeable porous brick having a top, bottom, sides and a passageway therethrough, where the top of the porous brick is attached to the bottom of the plate brick, a gas pool for containing gas surrounds the sides of the porous brick, and a submerged nozzle having a top, bottom and sides, where the sides have shoulder portions, has the top of the submerged nozzle attached to the bottom of the porous brick. A metal casing surrounds the unitary assembly so that the metal casing surrounds and supports a portion of the sides of the plate brick, a portion of the bottom of the plate brick, the sides of porous brick, and a portion of the sides of the submerged nozzle, including the shoulder portions. The metal casing further includes gas feed and discharge pipes therethrough in communication with the gas pool.

5 Claims, 6 Drawing Sheets

REFRACTORY BLOCK FOR CONTINUOUS CASTING

INDUSTRIAL FIELD OF THE INVENTION

This invention relates to refractory blocks for slide gate valve which is used for controlling the flow of a molten steel in continuous casting equipment of the molten steel.

BACKGROUND

From the recent viewpoint of laborsaving it is required to simplify and accelerate the working of incorporating a brick into a slide gate valve, and therefore it is adopted o integrally set a slide plate and a chute nozzle. Conventionally, in such an integrating method it has been general to set the slide plate and the chute nozzle by using a filler such as mortar or castable in a one-body metal casing which is formed to envelop the side surface and bottom surface of said slide plate and the side surface of said chute nozzle.

However, such a system has demerits in that parallelism can hardly be retained between the sliding surface and the bottom surface of the metal casing because of the fluidity of the filler, and a long period of time is required for the complete hardening of the filler.

To remove such demerits the applicant of the present application previously proposed to employ "an Accommodation Structure of Refractory for Slide Valve" (Utility Model Publication No. 2-35405).

By adopting such an accommodation structure it has become to easily take a parallelism of the slide plate, to accelerate adhesion, and to easily manufacture the refractory block for slide gate valve by ordinary cutting, welding or the like of the steel material. However, with such an accommodation structure the steel plate fixed to the bottom surface of the slide gate valve has no sufficient strength, and it is known that because of thermal expansion of the metal casing a clearance is likely to occur between the slide plate or seal plate and the mortar-bonded seal nozzle or the submerged nozzle, troubles occasionally occur due to metal insertion or the like, and a complete integration is impossible.

Conventionally, a plate brick and a submerged nozzle are of split type. However, the object of the present invention is to provide a refractory block usable for multi-continuous casting in such a way that said plate brick and said submerged nozzle are formed integrally, the integral body is covered by a metal casing so that it has in combination a sufficient mechanical strength, a corrosion resistancy, an anti-spalling property and the like whereby a clearance is not created in the joint portion, and a nozzle blocking caused by the metal insertion or air suction is prevented so as to improve the quality of steel.

DISCLOSURE OF THE INVENTION

To eliminate the above-mentioned various drawbacks of the known system the inventors of the present invention have made intensive, various studies and tests, and as a result they have been successful in developing the refractory block for continuous casting of the present invention. The technical constitution of the invention is such that the outer peripheral surface of that the plate brick accommodated in a metal casing is joined through mortar or packing with the dowel portion of the submerged nozzle accommodated in another cylindrical metal casing, and the two metal casings are integrally welded together, that the plate brick and the submerged nozzle are formed as a one-body refractory block, this block is enclosed by the one-body metal casing whereby said one-body refractory block may be mounted with the one-body metal casing through a castable refractory, that said one-body refractory block may be combined with a hetero-material refractory, or that a porous brick is involved between the plate brick and the submerged nozzle so as to be mounted in a one-body metal casing whereby said porous brick may be provided with a feed and discharge pipe piercing through the metal casing.

Further, the present invention is characterized in that a steel sleeve is of such shape that can fit and mount an assembly of the plate brick and submerged nozzle of a continuous casting slide gate valve apparatus, said steel sleeve has a shoulder in the upper portion of the submerged nozzle side, and the submerged nozzle and the plate brick are fitted and mounted together through a pressing force-giving ring having a desired thermal expansion coefficient in the inner peripheral surface of said shoulder. Furthermore, the invention is characterized in that the steel sleeve mounted with a continuous casting plate brick and the pressing force-giving ring are internally provided in the shoulder, and the steel sleeve mounted with the submerged nozzle is fitted and welded with them. Alternatively, the shoulder of said steel sleeve may be crossed with or inclined to the axis of the submerged nozzle, or an air-cooling jacket may be provided in the outer periphery of the steel sleeve.

THE BEST MODE OF CARRYING OUT THE INVENTION

Some embodiments of the refractory blocks of the present invention will now be described with reference to the accompanying drawings.

Figure 1:
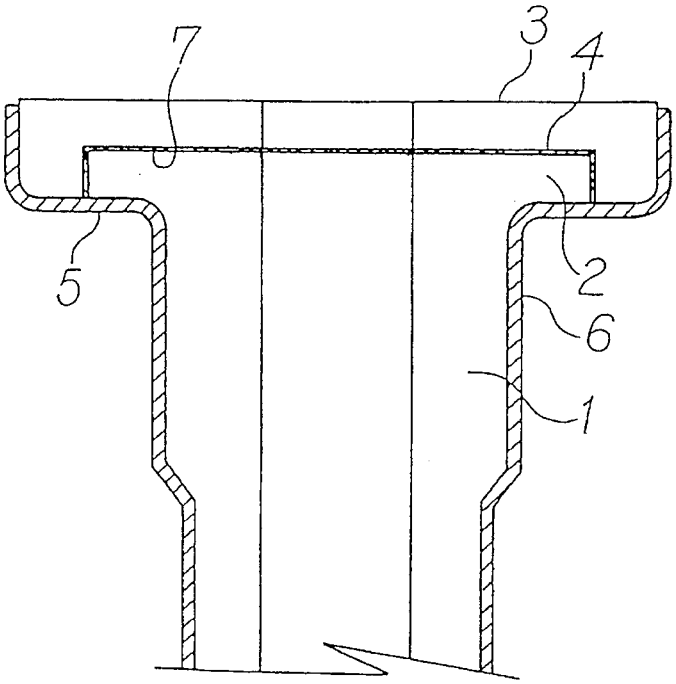
FIG. 1 is a vertical sectional view showing a basic embodiment of the invention.

The embodiment shown in FIG. 1 is a refractory block for continuous casting of the invention, wherein the outer peripheries of a plate brick 3 and a submerged nozzle 1 are enclosed directly by a one-body metal casing 6. The plate brick 3 is constituted to have a recess 4 in the joint surface with the submerged nozzle 1, a collar portion 2 of the submerged nozzle 1 is closely fixed to and fitted in said recess 4 thereby forming an assembly, this assembly is enveloped by and fitted into said one-body metal casing 6, and said collar portion 2 is supported by a shoulder 5 of the metal casing 6.

In this embodiment, the submerged nozzle 1 is made of an ordinarily used $Al_2O_3$—C or a molten quartz refractory, and the collar portion 2 of the submerged nozzle cooperates with the shoulder 5 of the metal casing 6 to prevent creation of a clearance in the joint surface with the plate brick. Said recess 4 is of a depth of ⅓ to ½ of the thickness of the plate brick, for example a depth of 15 to 20 mm, while the inner surface of said recess is made as smooth as possible to closely adhere the recess 4 and the plate brick 3. The metal casing 6 is formed integrally by an ordinary process with a heat-resistant steel such as ordinary steel or stainless steel, and in the case of using mortar or a packing 7 the metal casing is constituted by high alumina mortar, alumina-carbon mortar or ceramic packing.

Figure 2:
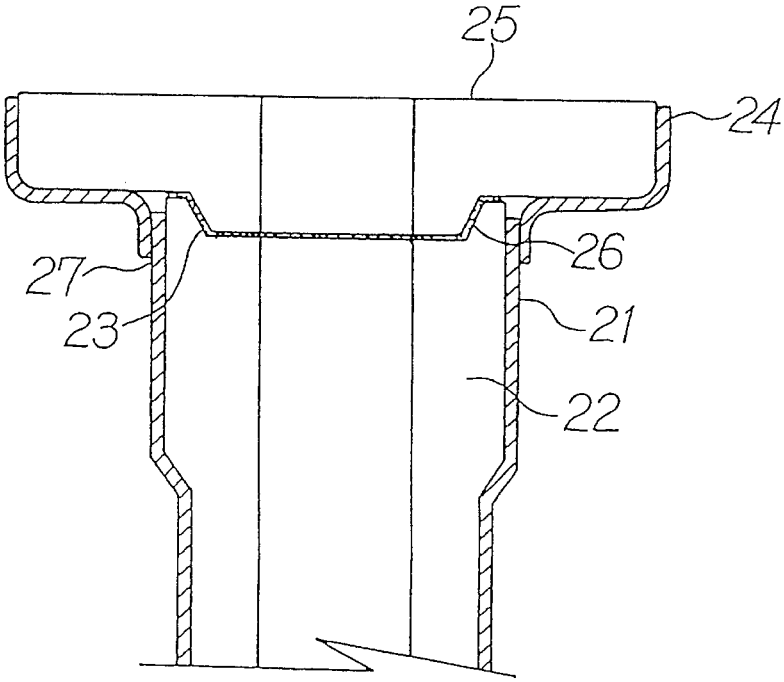
FIG. 2 is a vertical sectional view of another embodiment wherein a metal casing is welded.

The embodiment shown in FIG. 2 is such that a plate brick 25 accommodated in a metal casing 24 is connected via mortar or packing 26 to a dowel portion 23 of a submerged nozzle 22 previously accommodated in cylindrical metal casing 21, and said metal casings 21, 24 are joined together by means of spot welding or whole-peripheral welding 27.

Figure 3:
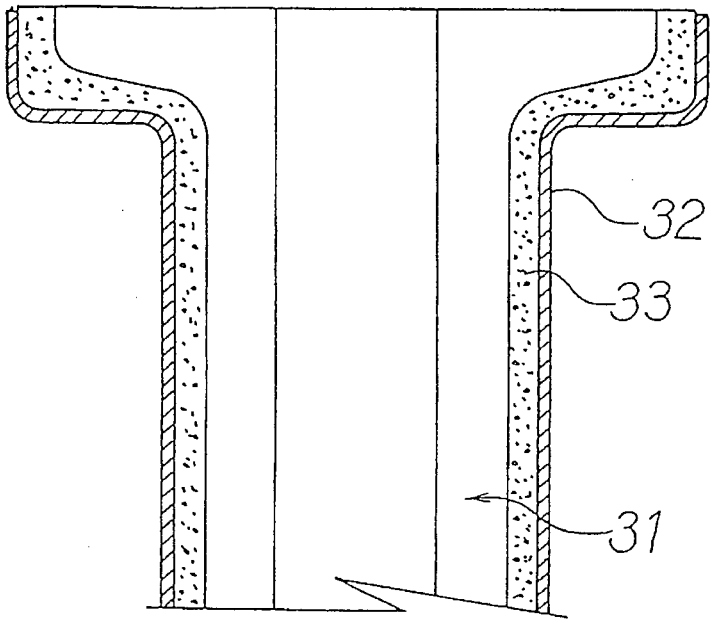
FIG. 3 is a vertical sectional view of still another embodiment which consists of a one-body refractory block and a one-body metal casing.

In the embodiment illustrated in FIG. 3, the plate brick and the submerged nozzle are formed as a one-body refractory block 31, this block is fitted in a one-body metal casing 32 through a castable refractory 33, and it may be possible that without using said castable refractory the one-body refractory block 31 is enclosed directly by the one-body metal casing 32.

Figure 4:
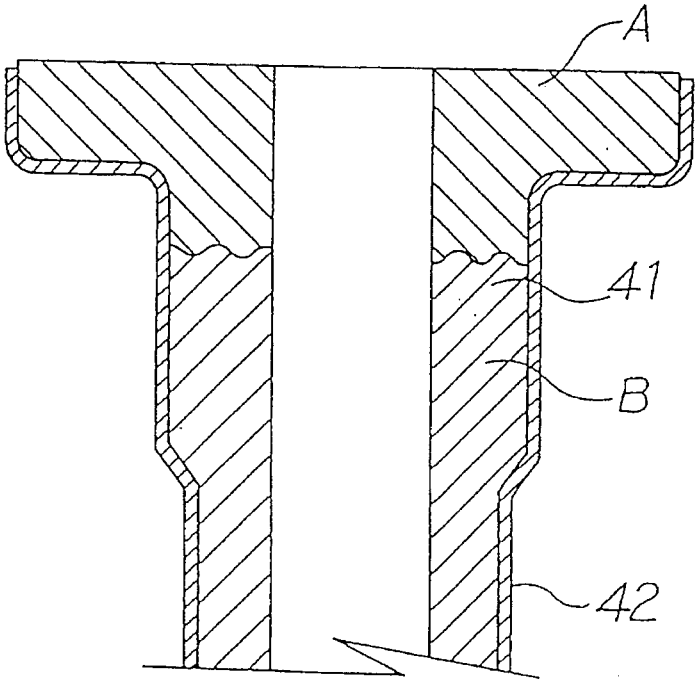
FIG. 4 is a vertical sectional view of still another embodiment wherein the refractory block is made of a hetero-material.

The embodiment shown in FIG. 4 is such that a one-body refractory block 41 is constituted by different materials such as $Al_2O_3$—C refractory (C content being 5 to 10% by weight) in portion A and $Al_2O_3$—C refractory (C content being 25 to 35% by weight) in portion B, and a one-body refractory block 41 constituted by these two kinds of materials is fitted in and enclosed by a one-body metal casing 42.

Figure 5:
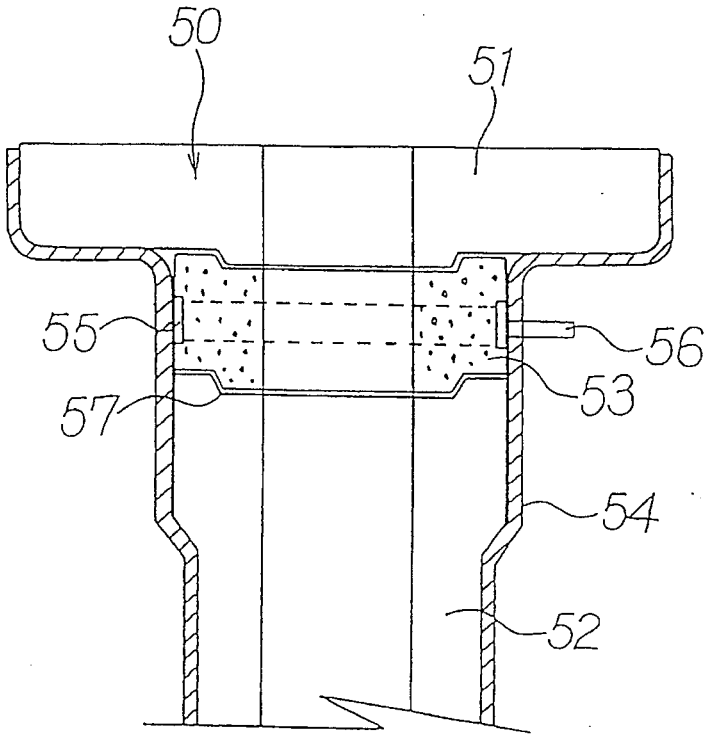
FIG. 5 is a vertical sectional view of still another embodiment which comprises a porous refractory.

FIG. 5 illustrates an embodiment wherein the one-body refractory block is provided with a porous brick for feeding and discharging gas, and a one-body refractory block is mounted in a one-body metal casing 54, said one-body refractory block being fitted (preferably an optional dowel portion is provided) with a porous brick 53 between a plate brick 51 and a submerged nozzle 52, said porous brick 53 being ring-shaped (having a molten metal passage opening at its center). A gas pool 55 is provided in the outer periphery of said porous brick 53, and a gas feed and discharge pipe 56 communicates with said gas pool 55 piercing through a metal casing 54.

Figure 6:
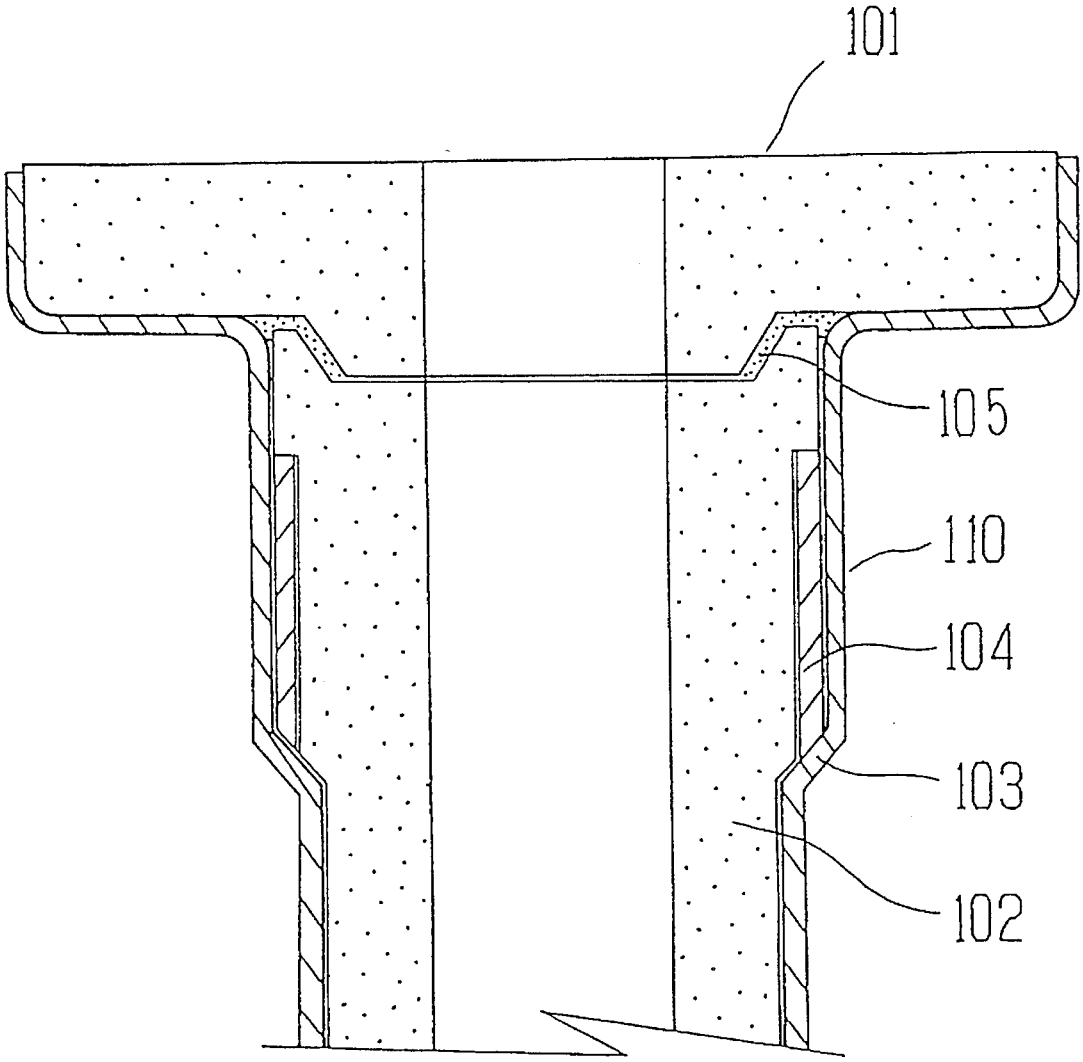
FIG. 6 is a vertical sectional view of an embodiment of the invention, which is provided with a pressing force-giving ring.

FIG. 6 shows a vertical sectional view of the refractory block of the invention, which is described in claim 1. The reference numeral 101 designates a plate brick, and 102 a submerged nozzle. The reference numeral 110 designates a steel sleeve, this sleeve is of such shape that it encloses the respective outer peripheries of both the side and bottom surfaces of said plate brick 101 in its upper stage, and that the middle stage and the lower stage enclose the outer periphery of said submerged nozzle 102. That is, the steel sleeve 110 is ordinarily cylindrical, but a shoulder 103 is arranged between the middle stage and the lower stage, and the lower stage is smaller than the middle stage in diameter. Though said shoulder 103 as illustrated in FIG. 6 forms an inclined shoulder the shoulder may be one crossing straight with the axis of the submerged nozzle 102.

The reference numeral 104 indicates a pressing force-giving ring which is arranged in the inner circumference of the middle stage of said steel sleeve 110 and which has a desired thermal expansion coefficient, and in case the steel sleeve 110 is made of steel for general structure the pressing force-giving ring 104 is made as a copper ring.

According to the present refractory block as constituted above, the pressing force-giving ring 104 is disposed at a predetermined position of a steel sleeve 110, the submerged nozzle 102 is fitted in and mounted to the sleeve 110, and then the plate brick 101 is fitted and mounted thereon via the mortar 105. Otherwise an assembly in which the submerged nozzle 102 and the plate brick 101 are integrally formed in advance is fitted in and mounted to the steel sleeve 110.

Therefore, if the submerged nozzle riss in temperature to about 700° C. when used for continuous casting the expansion coefficient of the steel sleeve becomes 0.83% and that of the pressing force-giving ring (made of steel) 0.15% so that the expansion coefficient of the pressing force-giving ring is greater by 0.32%. At that time a force of pressing up the submerged nozzle acts thereby resulting in that the joint opening between the submerged nozzle and the plate brick can be prevented.

Figure 7:
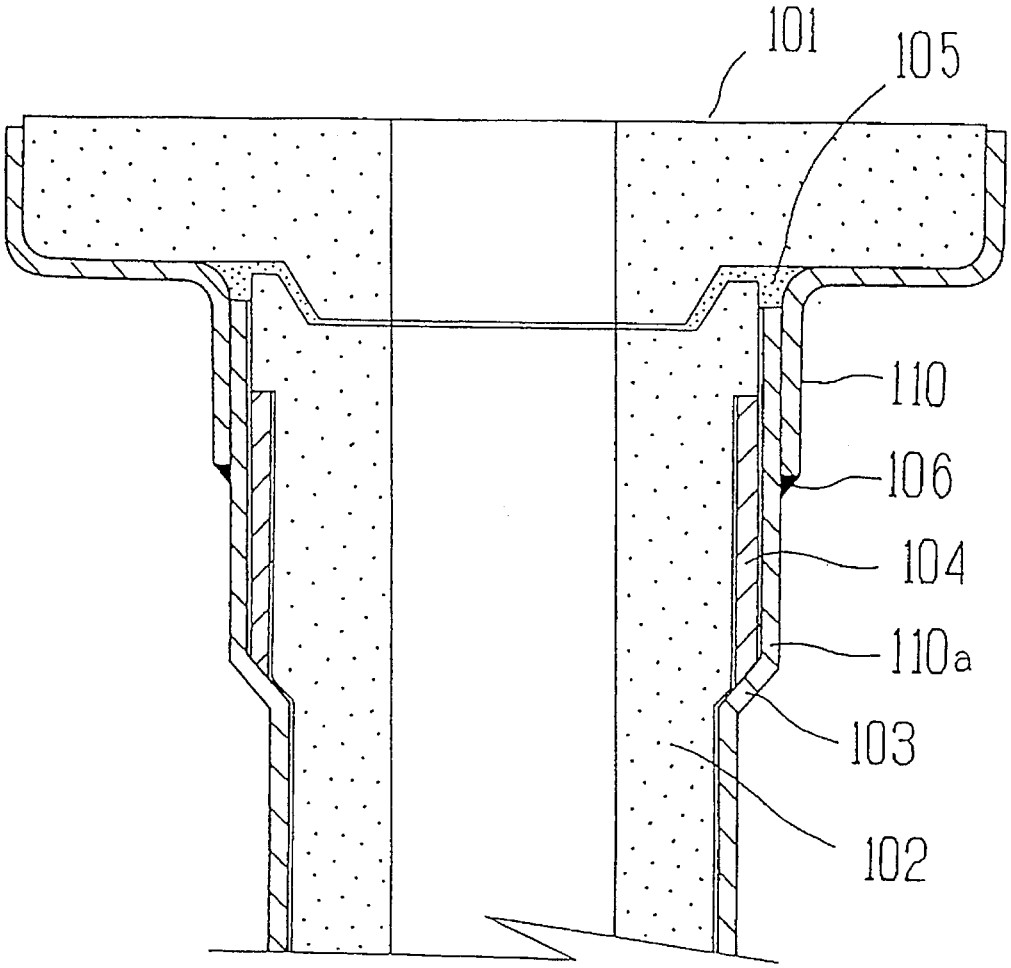
FIG. 7 is a vertical sectional view similar to FIG. 6, where a split-type steel sleeve is employed.

FIG. 7 is a vertical sectional view showing still another embodiment of the present invention described in claim 9. The reference numerals same as those of FIG. 6 show the same members.

In this embodiment, the steel sleeve 110 is split into upper and lower two parts, the plate brick 101 is fitted in and mounted to said sleeve 110, the pressing force-giving ring 104 is arranged in the upper inner peripheral surface of said shoulder 103 in the steel sleeve **110*a* having the shoulder 103, and thereafter the submerged nozzle 102 is fitted in and mounted to the steel sleeve 110*a*. Thus the plate brick 101 and the submerged nozzle 102 is made an assembly via the mortar 105 while said sleeves 110, 110*a* are made one-body by welding at 106 the entire peripheries thereof. Additionally, as shown, said steel sleeves 110 and 110*a* are fitted together by inclining the sleeve 110*a* inwardly, and therefore, the outer diameter of the sleeve 110*a* is approximately equal to the inner diameter of the sleeve 110**.

Figure 9:
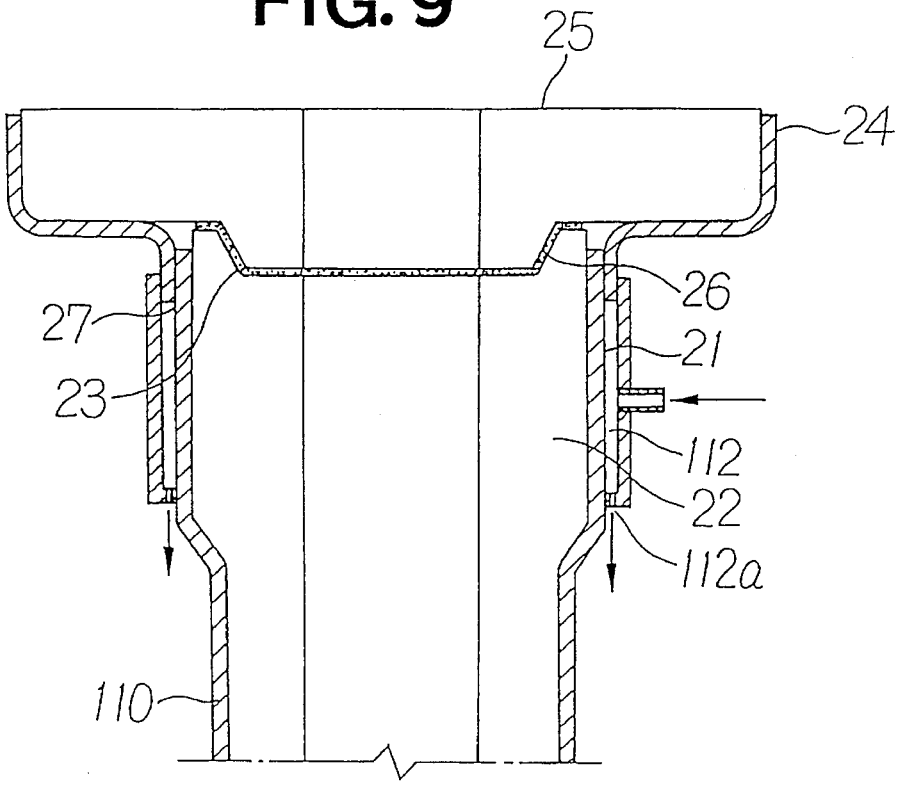
FIG. 8 and FIG. 9 are vertical sectional views of other embodiments wherein an air-cooling jacket is provided in the outer periphery of the steel sleeve.
Figure 8:
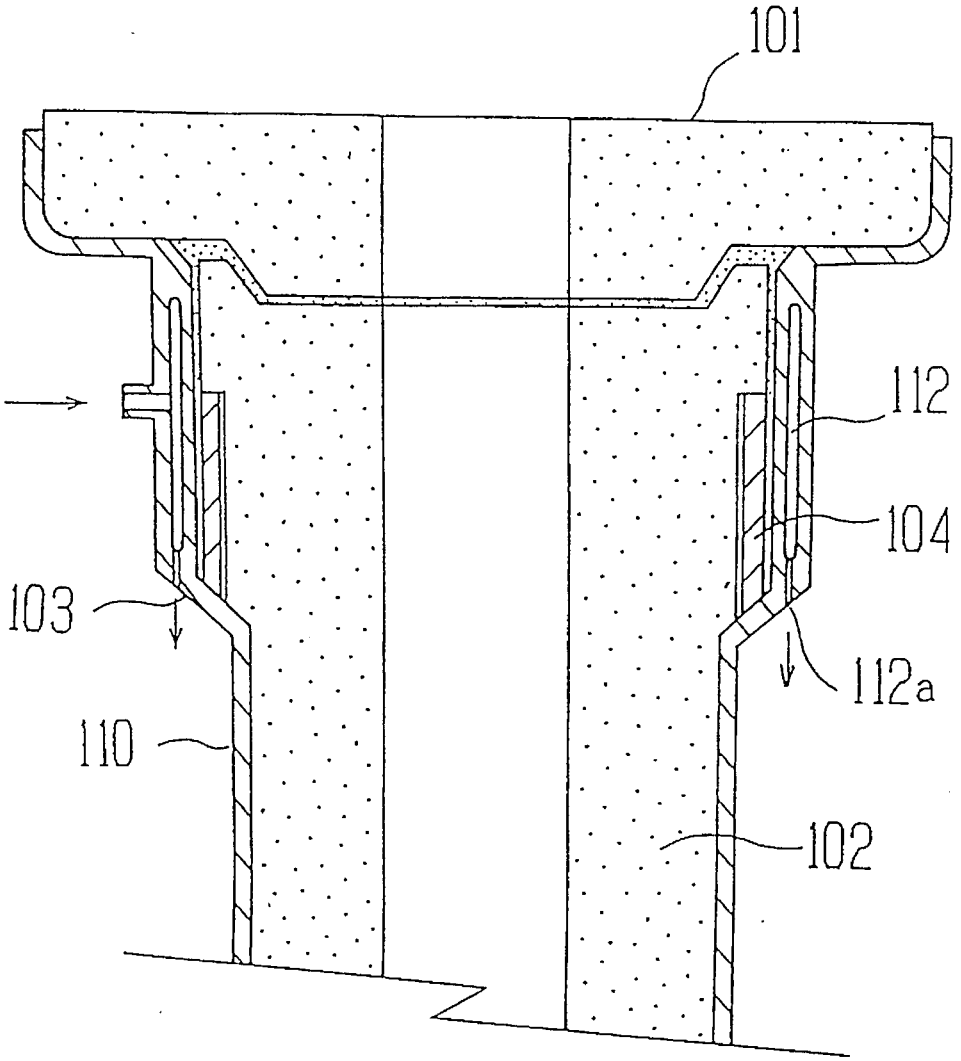

FIG. 8 is a vertical sectional view showing an embodiment wherein the outer periphery of the steel sleeve 110 is provided with an air-cooling jacket 112 having an air discharge opening **112*a*. Unlike in FIG. 9 said air-cooling jacket 112 may not be integral with the steel sleeve 110**, but it may be constructed by providing a separate member. By cooling the equipment through such constitution it is capable of controlling the thermal expansion of the steel sleeves whereby the force for pressing the submerged nozzle upward can act to a great extent.

By the above technical constitution the present invention provides the following advantages.

(1) By making the plate brick and the submerged nozzle integral by a metal casing it is possible to prevent a nozzle blocking caused by air sucked from the joint portion to allow the quality of steel to be improved thereby intending a continuous casting.

(2) It is possible to prevent the nozzle from blocking by sucking and removing the air occasionally contained in the molten steel, and if necessary, by supplying an inert gas.

(3) The plate brick and the submerged nozzle are formed integrally by a steel sleeve, the submerged nozzle is pressed up by making advantage of the thermal expansion of the pressing force-giving ring to prevent the joint opening between said brick and said nozzle whereby troubles caused by air suction can be avoided so as to improve the working efficiency of the continuous casting.

We claim:

1. A refractory block for continuous casting comprising:

a unitary assembly comprising:

a plate brick having a top, a bottom, sides and a passageway therethrough;

a gas permeable porous brick having a top, a bottom, sides and a passageway therethrough, said top of said porous brick being attached to said bottom of said plate brick;

a gas pool surrounding said sides of said porous brick for containing a gas; and a submerged nozzle having a top, a bottom and sides, said sides of said submerged nozzle having a shoulder portion, said top of said submerged nozzle being attached to said bottom of said porous brick; and a metal casing surrounding said unitary assembly such that said metal casing surrounds/and supports a portion of said sides of said plate brick, a portion of said bottom of said plate brick, said sides of said porous brick and a portion of said sides of said submerged nozzle including said shoulder portion, said metal casing having a gas feed and discharge pipe therethrough in communication with said gas pool.

2. A refractory block for continuous casting comprising:

a unitary assembly comprising a plate brick having a top, a bottom, sides and a passageway therethrough, and a submerged nozzle having a top, a bottom, sides and a passageway therethrough, said sides of said submerged nozzle having a shoulder portion, said bottom of said plate brick being joined to said top of said submerged nozzle;

a metal casing surrounding and supporting said unitary assembly such that said metal casing surrounds and supports a portion of said sides of said plate brick, a portion of said bottom of said plate brick and a portion of said sides of said submerged nozzle including said shoulder portion; and a pressing ring made from a material with a different coefficient of expansion than that of said metal casing, said press ring mounted within said metal casing and positioned to exert a force on said submerged nozzle to urge said submerged nozzle toward said plate brick when the temperature of said pressing ring increases.

3. A refractory block as in claim 2, wherein said metal casing comprises two parts, an upper part surrounding a portion of said sides of said plate brick and a portion of said bottom of said plate brick and a lower part surrounding a portion of said sides of said submerged nozzle including said shoulder portion, said upper part of said metal casing being attached to said lower part of said metal casing such that said distance between said portion of said upper part supporting said bottom of said plate brick and said portion of said lower part supporting said shoulder portion of said submerged nozzle may be varied before attachment.

4. A refractory block as in claim 2, further comprising an air cooling jacket surrounding said metal casing.

5. A refractory block as in claim 3, further comprising an air cooling jacket surrounding said metal casing.

* * * * *